United States Patent [19]

Giacomelli et al.

[11] 3,992,857

[45] Nov. 23, 1976

[54] ARRANGEMENT FOR CAPPING MACHINES

[75] Inventors: Peter Giacomelli, Lund; Alvar Olsson, Dalby, both of Sweden

[73] Assignee: Sobrefina SA, Fribourg, Switzerland

[22] Filed: Nov. 7, 1975

[21] Appl. No.: 630,016

[30] Foreign Application Priority Data

Nov. 18, 1974 Sweden ..... 7414433

[52] U.S. Cl. ..... 53/306; 53/319; 53/328

[51] Int. Cl.[2] ..... B65B 7/28; B67B 1/00

[58] Field of Search ..... 53/306, 308, 319, 328, 53/317

[56] References Cited

UNITED STATES PATENTS

| | | | |
|---|---|---|---|
| 2,434,053 | 1/1948 | Resina | 53/306 |
| 2,849,848 | 9/1958 | Ravn | 53/328 X |
| 3,538,678 | 11/1970 | Lefort | 53/319 |
| 3,777,449 | 12/1973 | Sindermann | 53/306 X |
| 3,852,941 | 12/1974 | Bross | 53/317 |

*Primary Examiner*—Travis S. McGehee
*Assistant Examiner*—Horace M. Culver
*Attorney, Agent, or Firm*—Pierce, Scheffler & Parker

[57] ABSTRACT

A capping machine of the rotary type for closing filled bottle type packing containers for beer or other liquids which are made from a plastic material includes a lower wheel on which the bottles to be capped are placed and an upper wheel which supports closing rams which are movable vertically towards and away from the bottles by means of a cammed track. Caps loaded into a magazine are transferred one by one to the rams as the wheels turn, and the bottles are capped as the ram moves downward onto the bottle mouth.

5 Claims, 2 Drawing Figures

ARRANGEMENT FOR CAPPING MACHINES

The present invention relates to an arrangement for capping machines of the type where filled packing containers moving continuously along a track are provided with closing elements which with the help of closing rams, which are movable above the packing containers and synchronously with these, are taken along from the outlet opening of a magazine and are guided down towards the opening of the packing containers to be mounted there for the purpose of closing the packing containers.

For the closing of filled packing containers, e.g. bottles made substantially from plastic material for beer or the like, a cap likewise made from plastic material is used which with the help of a capping machine is applied to the opening of the bottle. A known capping machine is of the rotary type, that is to say it comprises a continuously rotating horizontal element resembling a sprocket wheel, into the peripheral recesses of which filled bottles are fed continuously. The bottles are allowed to accompany the wheel for approx. ¾ of a revolution, during which time they are provided with caps. Then they are removed from the wheel for further transport and packaging in collective cartons or the like. Above each recess in the periphery of the rotating wheel a vertically movable closing ram is arranged, which during the whole rotation of the wheel is constantly in such a position that its centre axis coincides with the centre axis of each of the bottles arranged in the recesses. The closing rams are supported by a wheel arranged above the wheel receiving the bottles and rotatable synchronously with the same, and they are controlled in vertical direction by a stationary annular cam curve which is largely horizontally arranged except for the place where the actual capping occurs, at which place the cam curve drops in the direction of the lower wheel with the object of bringing a surface at the bottom end of the closing ram co-operating with the caps, into contact with the cap under such a force that the same is pressed home into the bottleneck. Each closing ram comprises a telescopically and concentrically supported driving pin which is spring-loaded in the direction of the lower wheel and is thus movable within certain limits in a vertical direction, independently of the vertical position of the closing ram which is determined by the cam curve. To make possible the introduction and removal respectively of the bottles into and from the wheel adapted to receive the bottles, the closing rams first have to be raised with the help of the cam curve to such an extent that the bottles can be introduced into and removed from the wheel. Moreover the driving pins have to be pressed upwards into the closing rams against the effect of the spring of the closing rams. This is done with the help of a guide rail acting upon the bottom end of the driving pin. At the place where the bottles are introduced into the wheel a feed channel for caps is arranged which is arranged so that is tangential in relation to the wheel and it ends underneath the guide rail for closing ram. The feed channel is provided at the lower end with movable jaws by means of which one cap at a time is retained in a ready position. Owing to the guide rail for the driving pin terminating directly before this ready position, the spring-loaded driving pin will elastically move downwards and engage with its lower end in a recess in the cap and, owing to a simultaneous releasing of the jaws retaining the cap in ready position, take the cap along. The cap is guided in this by an extension of the feed channel which, seen in the direction of movement of the ram, successively approaches the bottle openings which are continuously movable underneath the same. The rail terminates immediately above the opening plane so that the cap, brought along between the rail and the driving pin, owing to the sudden absence of underlying support, is pushed down towards the opening of the bottle. At the same time the cam curve moves the closing ram in the direction of the bottle opening, the cap is pressed down into the bottle opening and the bottle is closed.

This capping machine was found to entail a certain risk of so-called oblique cappings, which means that cap and bottle are not completely in line with one another when the cap is moved along, and results in the cap being fitted at an angle in the opening hole. The reason for this is primarily that the closing ram, because of its telescopic construction, has a certain flexibility in lateral direction, and that the guiding channel owing to shortage of space cannot be constructed as stable as would be desirable. This is the case in particular at the bottom end, where the channel is very close to the plane of the bottlenecks.

It is a further disadvantage of the capping machine described that it comprises a great number of movable parts which are potential sources of error and give rise to a relatively high number of breakdowns.

A further disadvantage of this machine is that it cannot be reversed, since the spring-loaded driving pins in the closing rams would in this case strike against the closing ends of the guide rail as well as of the feed channel, with the consequence that the machine or in any case the driving pin would be damaged.

It is an object of the present invention to provide a capping machine which is not subject to the disadvantages of the known machine.

A further object of the present invention is to provide a capping machine which is simple in its construction and therefore reliable, easy to operate and cheap.

These and other objects have been achieved in accordance with the invention in that an arrangement of the type described earlier is given the characteristic that closing elements are delivered by force of gravity one at a time on to a surface arranged in connection with the outlet opening of the magazine, that closing rams are arranged to pass one at a time directly above the said surface and that the part of the closing ram co-operating with the closing elements is designed so, that as it passes the surface and takes along a closing element and retains the same by means of a snap locking achieved by a relative movement between the closing ram and the surface and moves it from the surface to the packing container.

A preferred embodiment of the arrangement in accordance with the invention has the characteristics which are evident from the accompanying drawings.

The invention will be described in greater detail in the following with reference to the enclosed schematic drawing.

Figure 1:
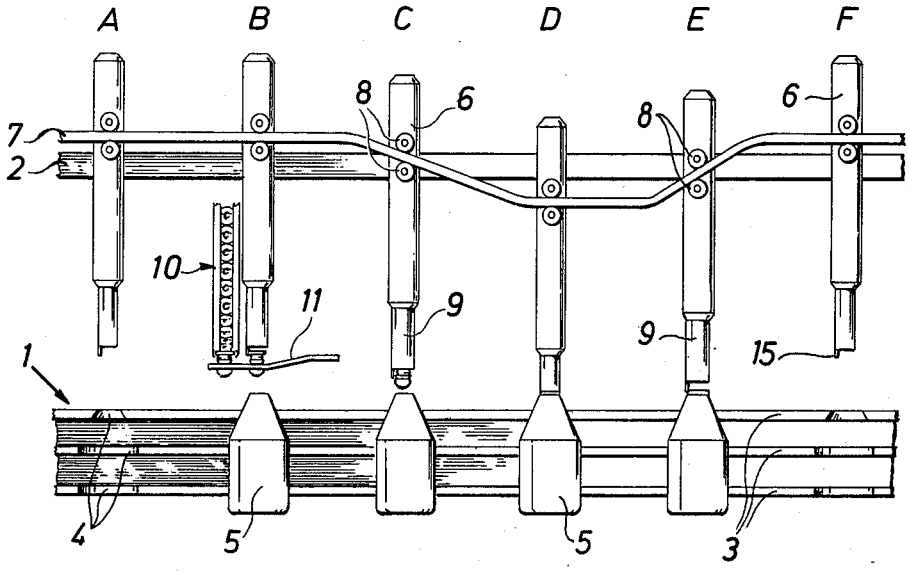
FIG. 1 is a view in elevation of the arrangement in accordance with the invention.

The capping machine in accordance with the invention shown in FIG. 1 is of the rotary type and comprises a lower wheel 1 which by means of a vertical axle (not shown on the drawing) is connected to an upper wheel 2. The lower wheel 1 has on its periphery three flanges 3 which arranged at a distance above one another. The flanges 3 are provided with a number of recesses 4 for receiving the bottles 5, which recesses 4 are arranged at equal distances around the periphery of the wheel 1. The size of the recesses 4 is adapted to the bottles 5 which are to be capped and the recess in the uppermost flange 3 is smaller than the rest so as to grip the upper tapering part of the bottle and to prevent the bottles from being lifted out of place.

The upper wheel 2 is connected rigidly with the lower wheel 1 and serves for supporting a number of closing rams 6, each of which is situated above and axially in line with a bottle recess 4 in the lower wheel 1. The closing rams 6 are supported in the wheel 2 in such a manner that they can move vertically upwards and downwards in the direction from or towards the co-operating bottle recess 4. The vertical movement and vertical position of the closing rams 6 is determined by a cam curve 7 in fixed position outside the periphery of the upper wheel 2. The cam curve 7 is in the form of a rail on which rollers 8, arranged on the closing rams 6, run while engaging the upper and lower side respectively of the rail, when the wheel 2 rotates to cause the closing rams to move upwards or downwards as a function of the shape of the curve. Since the closing rams 6 during the greater part of any one revolution will move in an upper position at a distance above the openings of the bottles 5 and thus make possible the unhindered introduction and removal of the bottles into and from the recesses 4 respectively, the cam curve 7 is during the greater part of the revolution horizontal and situated at a higher level. In that part of a revolution where the caps are applied to the bottles, however, the cam curve runs at a lower level, and between these two horizontal parts there are transition sections sloping in a suitable manner. Each closing ram 6 comprises an upper main part which is supported by the upper wheel 2 and carries the guide rollers 8. At the lower end of the main part there is a part 9 of the closing ram for engaging the caps, and this part is exchangeable to permit working with various kinds of caps and bottles. At one point along the periphery of the arrangement there is a fixed cap magazine or a feed channel 10 for dispensing caps which ends at the upper surface of an element 11 whose function will be described in detail in the following with reference to FIG. 2. The element 11, like the channel 10, is in a fixed position.

Figure 2:
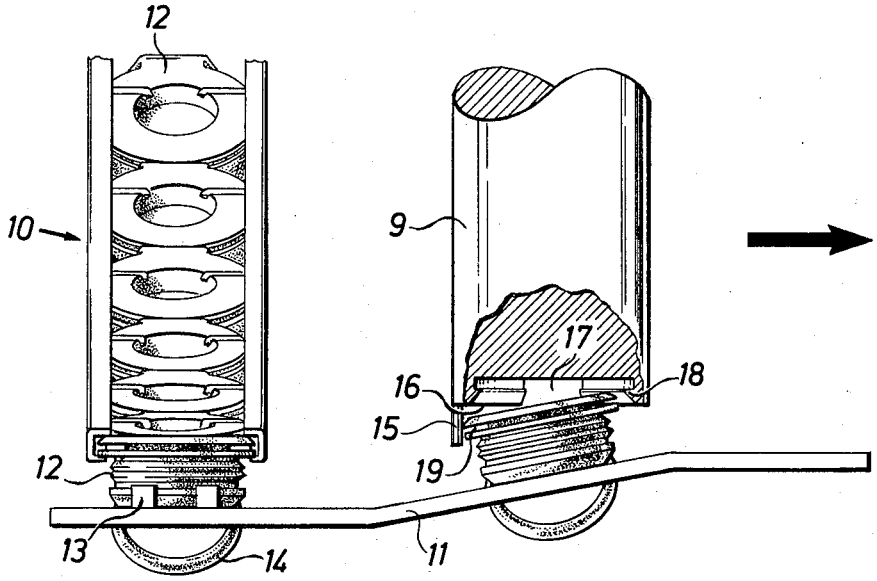
FIG. 2 is an elevational view of a part of the arrangement in accordance with FIG. 1 on a larger scale.

In FIG. 2 is shown, on a larger scale, the part of the closing machine where the feed of the caps takes place. The figure indicates that the feed channel 10 for the caps 12 comprises two elongated elements provided with tracks between which the caps are supported so that they are freely slidable. The channel 10 is substantially vertical at the top and continues smoothly downwardly to a lower horizontal opening at substantially right angles to the element 11 and at a height adapted to accommodate the cap above the upper surface of the element 11. The element 11 consist of a relatively narrow strip, and so as to prevent the lowermost cap 12 from being pushed over the edge of the surface under the pressure from the succeeding caps, the said edge is provided with stop lips 13. The distance between the stop lips and the opening of the channel 10 is adapted so that there is room for only one cap at a time between the element 11 and the opening. In cases where the caps 12 are provided with pull rings 14 for opening the bottles, these are oriented in such a manner when the caps 12 are introduced into the feed channel 10, that when the caps 12, one at a time slide out onto the upper surface of the element 11, rings 14 are outside one edge of the element 11. The part of the element 11 onto which the caps 12 slide out from the feed channel 10 consists of a horizontal surface which, seen in the direction of the rotation of the machine (towards the right of the drawing), rises gently upwards to an upper level, to end in a likewise horizontal surface situated at this upper level. In FIG. 2 is also shown the bottom end of the lower part 9 of a closing ram 6. The bottom end is designed for active co-operation with the caps and has therefore a special shape for each type of cap. All the embodiments of the lower part 9 of the closing ram, however, contain a driving element 15 which extends from the end of part 9 in the direction towards the element 11 and is situated at the rear edge of the part 9, seen in the direction of rotation of the closing ram (indicated by an arrow in FIG. 2). The embodiment shown, which is intended for co-operation with a circular plastics cap provided with an opening ring, comprises a recess facing downwards whose shape corresponds substantially to the shape of the upper part of the cap. The recess comprises an opening 17 for the pull ring and lips 18 which, when the cap is introduced into the recess, co-operate with a peripheral groove 19 present on the upper portion of the cap. When the cap is made of a resilient plastics material the lips may be rigid as the lower, bevelled, surface of the lips, on the introduction of the cap 12 into the recess, is then able to force aside the upper edge of the cap, which having passed the lips 18 springs out again so that the cap is retained in the recess. The introduction of the cap into the recess takes place with the help of the element 11 which will be explained in more detail in the following.

The function of the machine will now be described. When the machine is in operation the lower wheel 1 as well as the upper wheel 2 rotate continuously and synchronously. The wheels 1 and 2 are firmly connected to one another, so that each of the closing rams controlled by the upper wheel 2 co-operates the whole time with the same bottle recess 4 on the periphery of the wheel 1. For the sake of clarity only one such pair of closing rams 6 and bottle recesses 4 will be described, although the arrangement normally is provided with a number of evenly distributed pairs. In FIG. 1 the different positions are marked with letters A to F, which letters will be used successively to indicate the different positions through which each closing element passes in the course of one revolution of the wheels 1 and 2.

In position A the closing ram 6 is in an upper position which permits the placing of a bottle 5 into the recess 4 without the upper part or opening of the bottle being hindered by the lower part 9 of the closing rod ram 6.

When the closing ram 6 through the rotation of the disc 2 has been moved to the next position B it continues to be on the same level. During the displacement from position A to position B the closing ram 6 passes the feed channel for caps. The ram is at such a height that the lower end of part 9 can freely pass the cap 12 located outside the feed channel 10 on the element 11 (see FIG. 2). The distance between the lower end of part 9 and the surface of the element 11 on which is situated the actual cap 12 is such, however, that the driving element 15 of the closing ram will engage the cap edge and drive the cap towards the right on the drawing. The cap will then slide on element 11 so as to be situated exactly underneath the part 9 of the closing ram 6 and it is guided by the driving element 15 and the element 11. On continued displacement to the right the cap will, owing to the upwardly sloping surface of the element 11, gradually approach the recess 16 in part 9. After a certain distance of movement the front part of the cap (seen in the direction of movement) engages with the front portion of the projection 18 situated in the recess 16, and on continued movement up onto the upper level surface of the element 11, the remaining projection 18 too will engage with the periphery of the cap, so that the cap by means of a kind of snap-locking is retained in the recess 16 on the end of the closing ram.

In position C the closing ram, now provided with a cap, has started to lower itself towards the opening of the bottle 5 situated underneath it. During continued movement downwards in the direction of the position D the cap will now be introduced into the bottle opening and will be pressed down so that the bottle is closed.

The closing is completed when the closing ram 6 reaches the position D, but the lower end of the closing ram continues to engage the cap applied to the bottle.

On continued movement in the direction of E the closing ram commences to move upwards again, and in the position E the closing ram and the cap applied to the bottle have been disengaged. The separation of the closing ram and the cap takes place when the resilient edge of the cap is bent upwards so that the engagement of the projection 18 with the groove 19 ceases, the bottle being prevented from following because of the recess in the uppermost of the three flanges on the periphery of the wheel 1 being smaller and gripping the bottleneck. Since a certain force is required to separate the closing ram from the cap, this gives at the same time an indication that the capping has been carried out correctly and the cap is in its place in the bottle.

In position F the upwards movement of the closing ram has been completed and the closing ram is now on the same level as at the start of the process. In position F the bottle, provided with cap, can therefore be freely removed from the wheel 1 and be taken from the capping machine which means that the capping operation has been completed.

Certain variations of construction and of the design of the component parts are possible within the scope of the present invention. The design of the element 11, for example, can be varied within wide limits. The element 11 may even be provided with a plane, horizontal surface, the snap-locking being brought about by the relative movement between closing ram and element 11 when the cam curve controlling the closing rams is given a somewhat different shape, so that the closing rams commence their downwards movement directly after the cap feed channel 10. Furthermore it is also possible as mentioned earlier to adapt the lower part 9 of the closing ram to a number of different cap designs. The caps may be retained for example on the closing rams by means of a device designed like a press fastener, and if caps of magnetic material are used, the projection 18 for retaining the cap on the closing ram may be replaced by a magnet.

By the present invention a capping machine is provided in which the bottles introduced into the machine and the closing rams of the machine are accurately oriented in relation to one another during the whole of the closing process, which excludes any tendency towards deflection and consequently oblique capping. The fixing of the caps on the closing ram makes unnecessary any of the guide rails used previously, which means a simpler construction which is easier to service.

When the content of the bottles is beer, the absence of rails or similar elements located above the bottle opening constitutes a further advantage. This is because it is customary, after filling, to foam up the beer present in the bottles so as to prevent any air from getting into the bottle before capping. Thus a foam head is formed above the opening, and this foam head is partly sliced off by the guide rails during capping in the known machines, which means not only that the intended function is impaired, but it also leads to a deterioration in hygiene, since stale beer remaining on the guide rails may drop down into subsequent bottles. This disadvantage is eliminated by the arrangement according to the invention.

We claim:

1. In a machine for applying closure elements to containers having pouring openings at the top thereof in which at least the closure elements are composed of a resilient material, said machine having means for moving a plurality of upstanding, spaced containers along a horizontal path past a capping station, means including a plurality of vertically movable ram devices each disposed vertically above a container and moving synchronously therewith past the capping station, and a cam track for lowering each ram device as it passes the capping station, the improvement comprising means for dispensing single closure elements, an elongated track-like means having an upwardly inclined portion intermediate its ends for receiving and supporting each consecutive closure element as dispensed onto the lower end portion thereof, said track-like means being disposed above the horizontal path of the containers, means associated with the lower end of each ram device for moving the single closure element dispensed onto the lower end of the track-like means along said track-like means and up the inclined portion thereof so that said closure element approaches the lower end of the associated ram device at an angle thereto, one of the lower end of each ram device and the upper end of each closure element being provided with a recess means and the other being provided with a lip means for cooperating with the recess means whereby when the closure element and ram device reach the upper end of the track-like means the lip means and the recess means are engaged so that the closure element is transported by said ram device, said ram device subsequently forcing said closure element into the opening in said container as it is lowered by said cam track as it passes the capping station.

2. In a machine as claimed in claim 1 wherein said recess means is provided on the lower end of said ram device and the lip means are provided on the upper end of the closure element.

3. In a machine as claimed in claim 1 wherein the recess means comprises at least two opposed projections and the lip means comprises a peripheral flange element.

4. In a machine as claimed in claim 1 wherein the lower end of said elongated track-like means is provided with stop means for retaining a single closure element on said track-like-means.

5. In a machine as claimed in claim 1 wherein said means for dispensing said closure elements is disposed so as to dispense each closure element at right angles to said elongated track-like means.

* * * * *